US007507142B2

(12) United States Patent
Shibata

(10) Patent No.: US 7,507,142 B2
(45) Date of Patent: Mar. 24, 2009

(54) EYEGLASS LENS PROCESSING APPARATUS

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/326,332

(22) Filed: Jan. 6, 2006

(65) Prior Publication Data

US 2006/0178086 A1 Aug. 10, 2006

(30) Foreign Application Priority Data

Jan. 6, 2005 (JP) ..... 2005-001891

(51) Int. Cl.
*B24B 49/00* (2006.01)
*B24B 51/00* (2006.01)

(52) U.S. Cl. ..... 451/5; 451/8; 451/67; 451/71; 408/3; 408/103; 408/111

(58) Field of Classification Search ..... 451/5, 451/8, 54, 67, 71; 408/3, 103, 111
See application file for complete search history.

(56) References Cited

U.S. PATENT DOCUMENTS

RE35,898 E 9/1998 Shibata et al.
6,170,950 B1 * 1/2001 Yoshida ..... 351/110
6,325,700 B1 12/2001 Mizuno et al.
6,785,585 B1 * 8/2004 Gottschald ..... 700/159
6,790,124 B2 * 9/2004 Shibata ..... 451/5

FOREIGN PATENT DOCUMENTS

EP 1 090 716 A2 4/2001
EP 1 310 327 A2 5/2003
JP 02274408 A * 11/1990
JP 2003-145328 A 5/2003
JP 2004-9201 A 1/2004

* cited by examiner

*Primary Examiner*—Maurina Rachuba
(74) *Attorney, Agent, or Firm*—Sughrue Mion, PLLC

(57) ABSTRACT

An eyeglass lens processing apparatus includes; a drilling tool for forming a hole in an eyeglass lens; a first movement mechanism part that relatively moves the drilling tool relative to the lens; a target lens shape input section that inputs data of a two-dimensional target lens shape of the lens; a hole-position input section that inputs data of a position of a hole to be formed in a refractive surface of the lens, which is designated on a two-dimensional coordinate system of the input target lens shape; a measurement part that measures a shape of the refractive surface of the lens; a calculation section that corrects at least part of the input hole-position data into hole-position data along the measured refractive surface shape of the lens and determines hole processing data based on the corrected hole-position data; and a control section that controls the first movement mechanism part based on the determined hole-processing data.

5 Claims, 12 Drawing Sheets

EYEGLASS LENS PROCESSING APPARATUS

BACKGROUND OF THE INVENTION

The present invention relates to an eyeglass lens processing apparatus which performs drilling processing on an eyeglass lens in order to attach a rimless frame.

Generally, drilling (piercing) processing on an eyeglass lens, which is performed in order to attach a rimless frame, such as so-called a two-point frame, is manually performed by a drilling machine or the like. However, recently, an-eyeglass lens processing apparatus which automatically performs the drilling processing is proposed (see U.S. Pat. No. 6,790,124 (JP-A-2003-145328)).

In the automatic drilling processing under numerical control, hole-position data is input. The hole position can be designated with dimensions on a polar coordinate system with, as a reference, a geometric center of a two-dimensional target lens shape (traced outline shape) of the eyeglass lens. However, the hole position is usually designated with dimensions on an orthogonal coordinate system (with an x-axis direction as a horizontal direction and a Y-axis direction as a vertical direction of an eyeglasses) with, as a reference, the geometric center of the two-dimensional target lens shape or with dimensions from a lateral edge of a hole only in the x-axis direction. In any of the methods, the hole-position is designated on a two-dimensional coordinate system.

However, a refractive surface of the eyeglass lens, where to actually form a hole, has a three-dimensional curve, thus raising various inconveniences and contradictions in management of the hole-position data. For example, where to form two holes H1 and H2, side by side, vertically to the refractive surface of the eyeglass lens LE as shown in FIG. 10A, in case processing is made directly with using dimensions xc1 and xc2 of from the geometric center FC of the target lens shape or with using dimensions xh1 and xh2 of from the lateral edge of the holes H1 and H2, then the resulting spacing "da" between two holes H1 and H2, as viewed in a direction along the curve of the refractive surface, deviates from a designated hole spacing "d" under the influence of the curve (inclination) of the refractive surface, thus raising contradiction. This problem becomes conspicuous as the curve increases in the lens refractive surface.

SUMMARY OF THE INVENTION

The present invention has been made in view of the problem in the conventional art, and it is an object thereof to provide an eyeglass lens processing apparatus capable of arranging a hole position, etc. designated on a two-dimensional coordinate system onto a refractive surface of an eyeglass lens having a three-dimensional curve form without encountering any contradiction, thus allowing for suitable processing on the eyeglass lens.

In order to solve the aforesaid object, the invention is characterized by having the following arrangement.

(1) An eyeglass lens processing apparatus comprising:

a drilling tool for forming a hole in an eyeglass lens;

a first movement mechanism part that relatively moves the drilling tool relative to the lens;

a target lens shape input section that inputs data of a two-dimensional target lens shape of the lens;

a hole-position input section that inputs data of a position of a hole to be formed in a refractive surface of the lens, which is designated on a two-dimensional coordinate system of the input target lens shape;

a measurement part that measures a shape of the refractive surface of the lens;

a calculation section that corrects at least part of the input hole-position data into hole-position data along the measured refractive surface shape of the lens and determines hole processing data based on the corrected hole-position data; and a control section that controls the first movement mechanism part based on the determined hole-processing data.

(2) The eyeglass lens processing apparatus according to (1), wherein the hole-position input section inputs data of positions of a plurality of holes, to be formed side by side in the refractive surface of the lens, which are designated on the two-dimensional coordinate system of the input target lens shape, and the calculation section corrects at least part of the input hole-position data into hole-position data that provides a spacing of the holes along the refractive surface shape of the lens.

(3) The eyeglass lens processing apparatus according to (2), wherein the hole-position input section inputs the hole-position data such that the holes are arranged parallel to a direction perpendicular to the refractive surface of the lens, and the calculation section determines a direction of the holes to be perpendicular to the refractive surface of the lens at an intermediate point of the holes and corrects the hole-position data into hole-position data that a hole spacing is provided as a spacing along the refractive surface shape of the lens at the intermediate point of the holes.

(4) The eyeglass lens processing apparatus according to (1), wherein the hole-position input section inputs the hole-position data with reference to a geometric center or an edge of the input target lens shape, and the calculation section corrects the input target lens shape data into target lens shape data along the measured refractive surface shape of the lens and corrects the hole-position data, in the corrected target lens shape data, into hole-position data along the measured refractive surface shape of the lens.

(5) The eyeglass lens processing apparatus according to (4), further comprising:

a peripheral edge-processing tool for processing a peripheral edge of the lens; and a second movement mechanism part that relatively moves the peripheral edge processing tool relative to the lens, wherein the calculation section determines peripheral edge-processing data based on the corrected target lens shape data, and the control section controls the second movement mechanism part based on the determined peripheral edge-processing data.

(6) The eyeglass lens processing apparatus according to (1), wherein the calculation section corrects at least part of the input hole-position data, on a polar coordinate system having, as a reference point, a predetermined position in the input target lens shape.

(7) The eyeglass lens processing apparatus according to (1), wherein the calculation section corrects at least part of the input hole-position data, on an orthogonal coordinate system having, as a reference point, a predetermined position in the input target lens shape.

(8) The eyeglass lens processing apparatus according to (7), wherein the calculation section corrects at least part of the input hole-position data, on one axis direction of the orthogonal coordinate system.

DETAILED DESCRIPTION OF PREFERRED EMBODIMENTS

Figure 1:
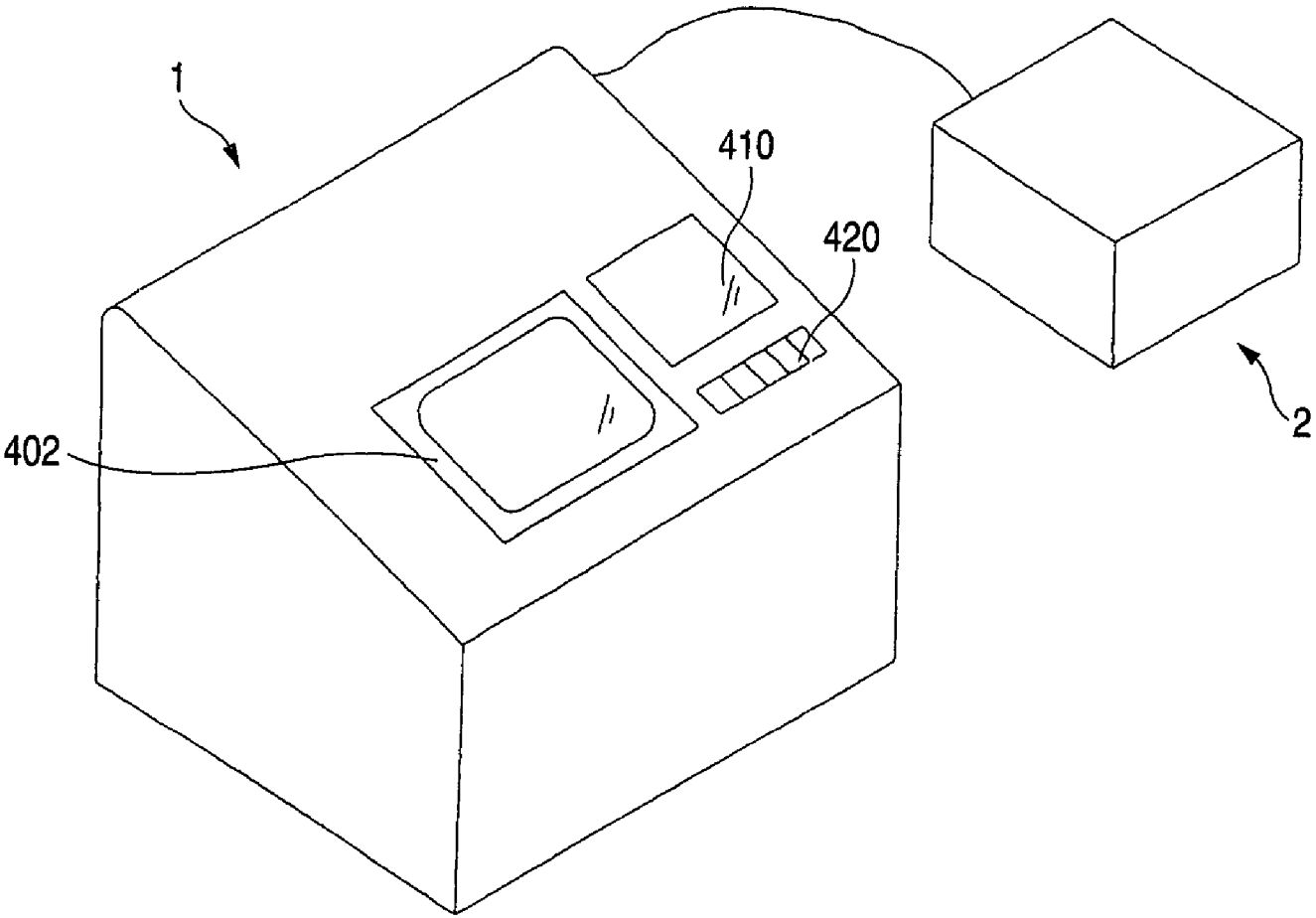
FIG. 1 is a schematic exterior view of an eyeglass lens processing apparatus according to an embodiment of the present invention.

Hereinafter, an embodiment of the present invention will be described according to the accompanying drawings. FIG. 1 illustrates a schematic configuration of an eyeglass lens processing system according to an embodiment of the present invention.

A frame shape measurement device 2 is connected to an eyeglass lens processing apparatus main body 1. A touch panel 410 and a switch portion having various switches for processing instructions, such as a processing start switch are arranged on an upper portion of the processing apparatus main body 1. The touch panel 410 also functions as a display portion for displaying processing information and an input portion for inputting processing conditions and the like. A processing chamber, described hereinafter, on which a peripheral edge processing part (unit) and the like are arranged is provided inside an opening-and-closing window 402. Incidentally, as the measurement device 2, the devices described in US Re.35898 (JP-A-H05-212661), U.S. Pat. No. 6,325,700 (JP-A-2000-314617) can be employed, for example. The measurement device 2 may be integrally formed with the processing apparatus main body 1.

(I) Peripheral Edge Processing Part

Figure 2:
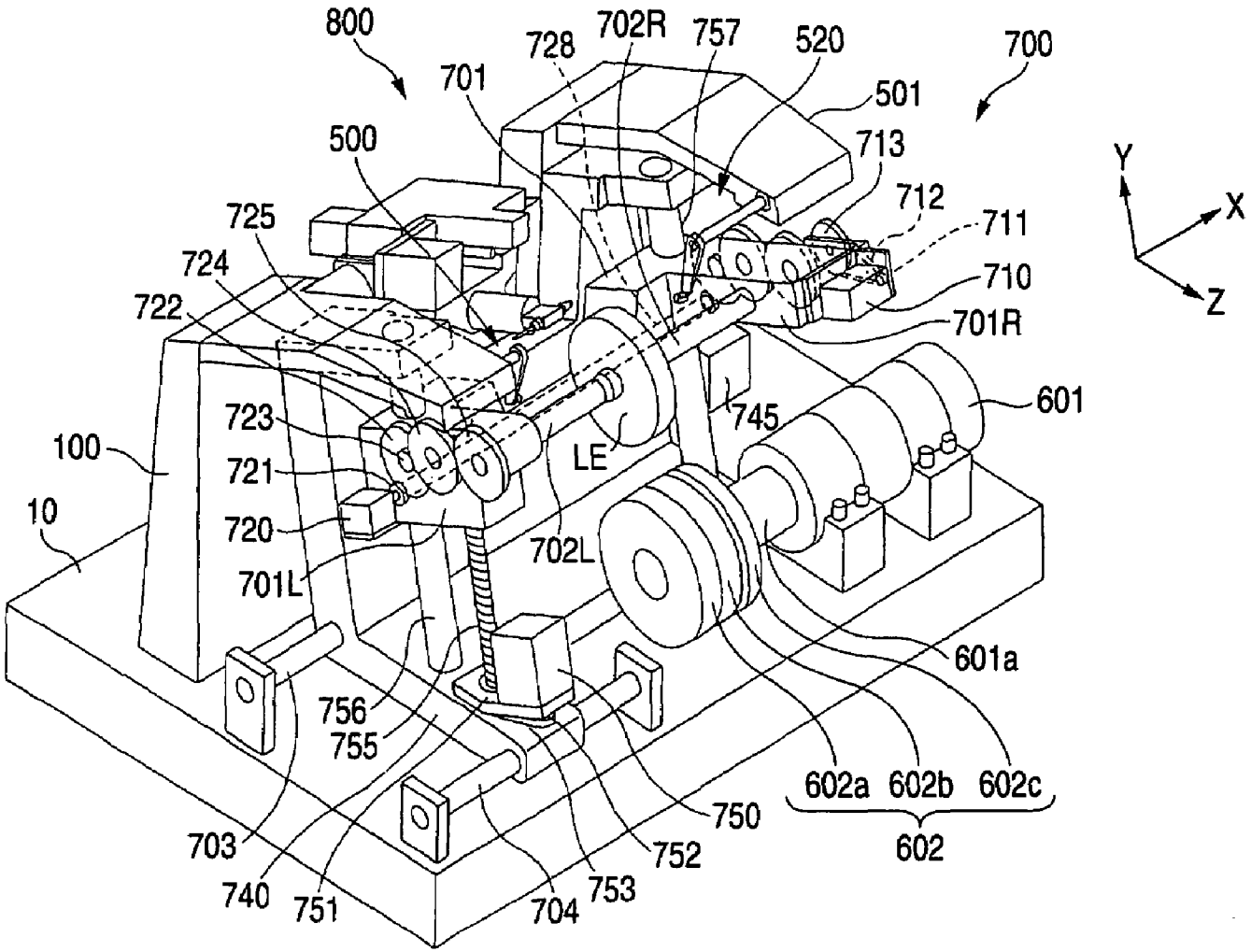
FIG. 2 is a schematic structural view of a peripheral processing part.
Figure 3:
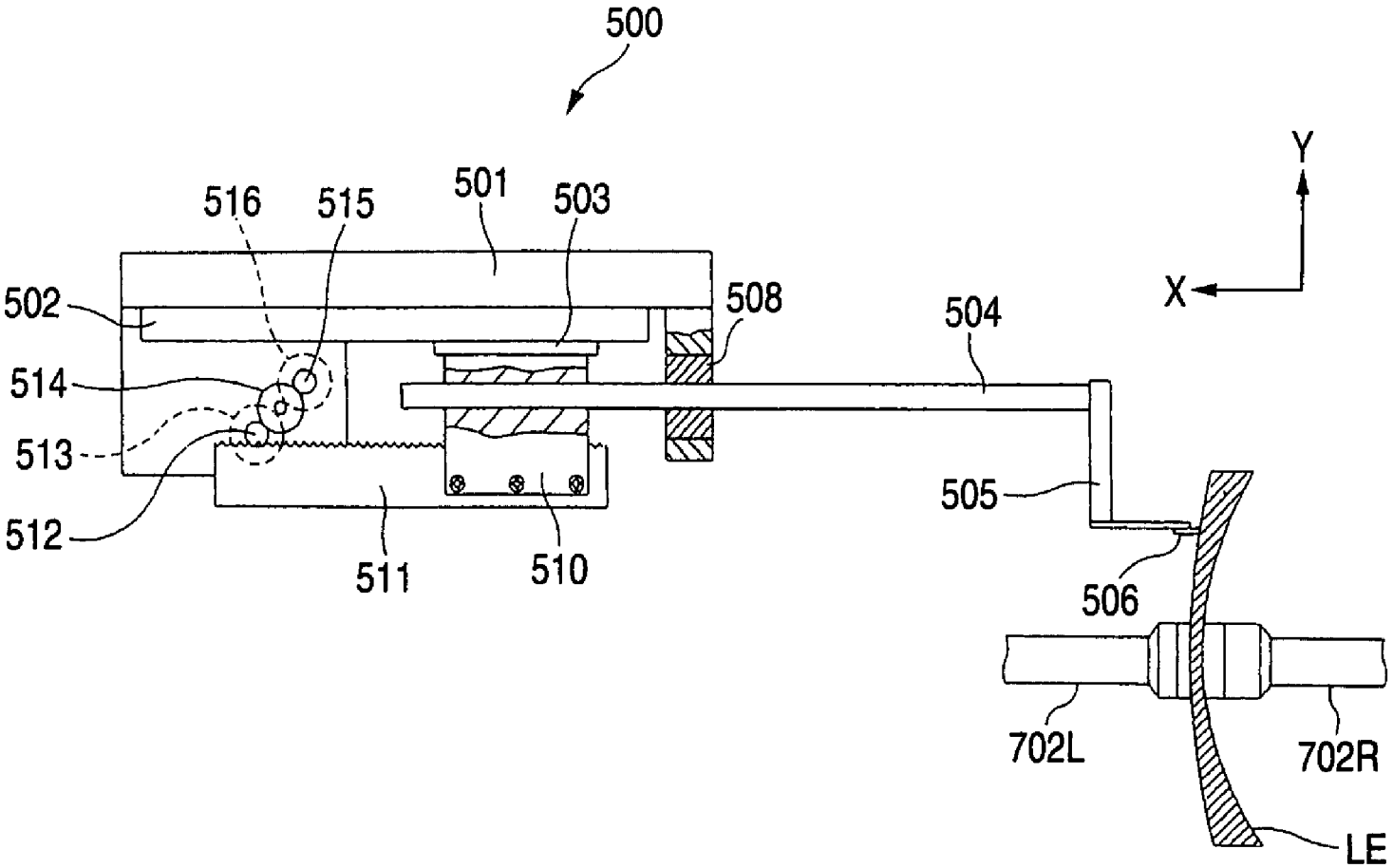
FIG. 3 is a schematic view of a lens shape measurement part.

FIG. 2 illustrates a schematic configuration of the peripheral edge processing part arranged inside the processing apparatus main body 1. The lens LE is held by lens chuck shafts (lens rotating shafts) 702L and 702R, and is subjected to the grinding processing by an grindstone group 602 attached to a grindstone rotating shaft 601*a* rotated by a grindstone rotating motor 601. The chuck shafts 702L and 702R and the shaft 601*a* are arranged in parallel to each other. The grindstone group 602 includes a roughing grindstone 602*a* for glass, a roughing grindstone 602*b* for plastic, and a finishing grindstone 602*c* for beveling processing and flatting processing.

Lens shape measurement parts (units) 500*a* and 520 described hereinafter are arranged at an upper portion of a carriage portion 700. A processing part (unit) 800 for drilling, chamfering and grooving, described hereinafter is arranged at a rear side of the carriage portion 700.

<Lens Chuck Mechanism and Lens Rotating Mechanism>

A lens chuck shaft 702L and a lens chuck shaft 702R are coaxially rotatably retained to a left arm 701L and a right arm 701R of a carriage 700 of the carriage portion 700, respectively. A lens chucking motor 710 is fixed to a front portion of the right arm 701R, and the rotation of the motor 710 is transmitted to a pulley 713 through a pulley 711 attached to a rotating shaft of the motor 710 and a belt 712. Thereby, The chuck shaft 702R is moved toward its center axis direction (chuck shaft direction. X-axis direction) through a feeding screw and a nut (not shown) rotatably held inside the right arm 701R, thereby the lens LE is held by the chuck shafts 702L and 702R.

A lens rotating motor 720 is fixed to a left end portion of the left arm 701L, and the rotation of the motor 720 is transmitted to the chuck shaft 702L through a gear 721 attached to a rotating shaft of the motor 720 and gears 722 through 725. The rotation of the motor 720 is also transmitted to the chuck shaft 702R through a rotating shaft 728 rotatably held at a rear side of the carriage 701 and gears at a right end portion of the right arm 701R. Thereby, the chuck shafts 702L and 702R are rotated about the center axis (chuck shaft) in synchronization with each other.

<Carriage Movement Mechanism>

A movable support base is supported by a carriage shafts 703 and 704 fixed to a base 10 to be slidable in their center axis direction. A motor 745 for horizontal movement is fixed to the base 10, and the rotation of the motor 745 is transmitted to the movable support base 740 through a ball screw (not shown) extending in parallel to the shaft 703 at a rear side of the movable support base 740. Thereby, the carriage 701 is moved in a horizontal direction (X-axis direction) together with the movable support base 740.

The carriage 701 is supported by shafts 756 and 757 which are fixed to the movable support base 740 and extend in a vertical direction (direction which varies an axis-to-axis distance between the chuck shafts 702 and 702R and the shaft 601*a*: Y-axis direction) to be slidable in their center axis direction. A motor 750 for vertical movement is fixed to the movable support base 740 through a plate 751, and the rotation of the motor 750 is transmitted to a ball screw 755 rotatably held by the plate 751 through a pulley 752 attached to a rotating shaft of the motor 750 and a belt 753. Thereby, the ball screw 755 is rotated and the carriage 701 is moved in the vertical direction (Y-axis direction), that is, the axis-to-axis distance between the chuck shafts 702L and 702R varies.

(II) Lens Shape Measurement Part

Figure 4:
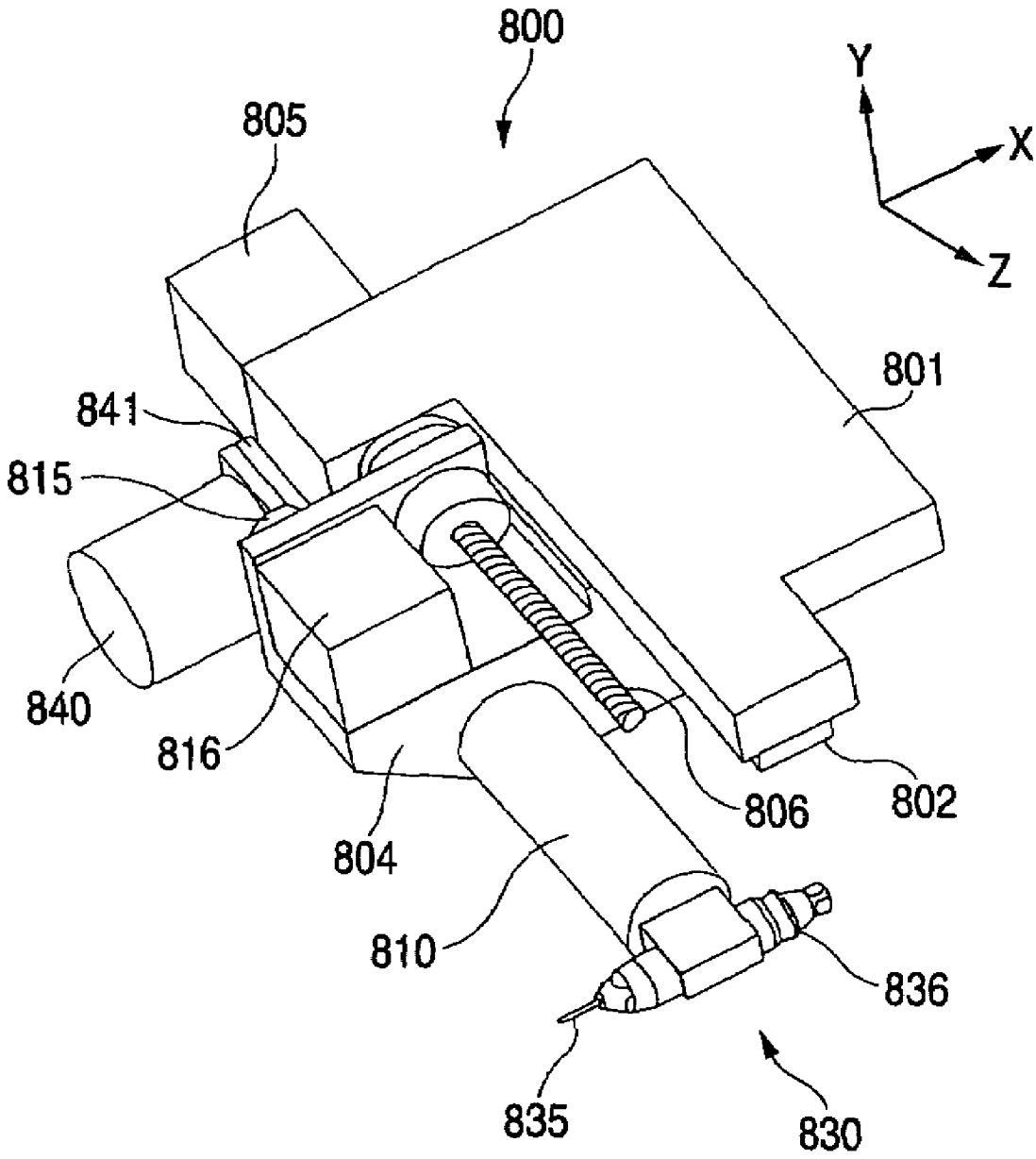
FIG. 4 is a schematic view of a drilling, chamfering and grooving processing part.

FIG. 4 is a schematic configuration of the lens shape measurement part (unit) 500 for measuring a front refractive surface shape of the lens LE. A support base 501 is fixed to a sub base 100 erected on the base 10 (see FIG. 2), and a slider 503 is slidably supported on a rail 502 fixed to the support base 501. A slide base 510 is fixed to the slider 503, and a feeler arm 504 is fixed to the slide base 510. A ball bushing 508 is fitted to a side surface of the support base 501, and has a rattling absorbing function. An L-shaped feeler hand 505 is fixed to an distal end of the arm 504 and a disk shape feeler 506 is attached to the distal end of the hand 505. To measure the shape of the front refractive surface of the lens LE, the feeler 506 is brought into contact with the front refractive surface of the lens LE.

A rack 511 is fixed to a lower portion of the slide base 510 and is meshed with a pinion 512 of an encoder 513 fixed to the support base 501. A motor 516 is fixed to the support base 501, and the rotation of the motor 516 is transmitted to the rack 511 through a gear 515 attached to the rotating shaft of the motor 516, an idling gear 514 and the pinion 512. Thereby, the slide base 510, the arm 504 and the like are moved in the horizontal direction (X-axis direction). When the lens shape is measured, the motor 516 always presses the feeler 506 to the lens LE with constant force. The encoder 513 detects a travel distance of the slide base 510 (position of the feeler 506) and the like in the horizontal direction. The front refractive surface shape of the lens LB is measured on the basis of this travel distance (position) and the rotation angle of the chuck shafts 702L and 702R.

Incidentally, the description of the structure of a measuring part (unit) 520 for a rear refractive surface shape of the lens LE is omitted since the structure thereof is symmetrical to the structure of the measuring part (unit) 500 for the front refractive surface shape of the lens LE.

(III) Drilling, Chamfering and Grooving Processing Part

Figure 5:
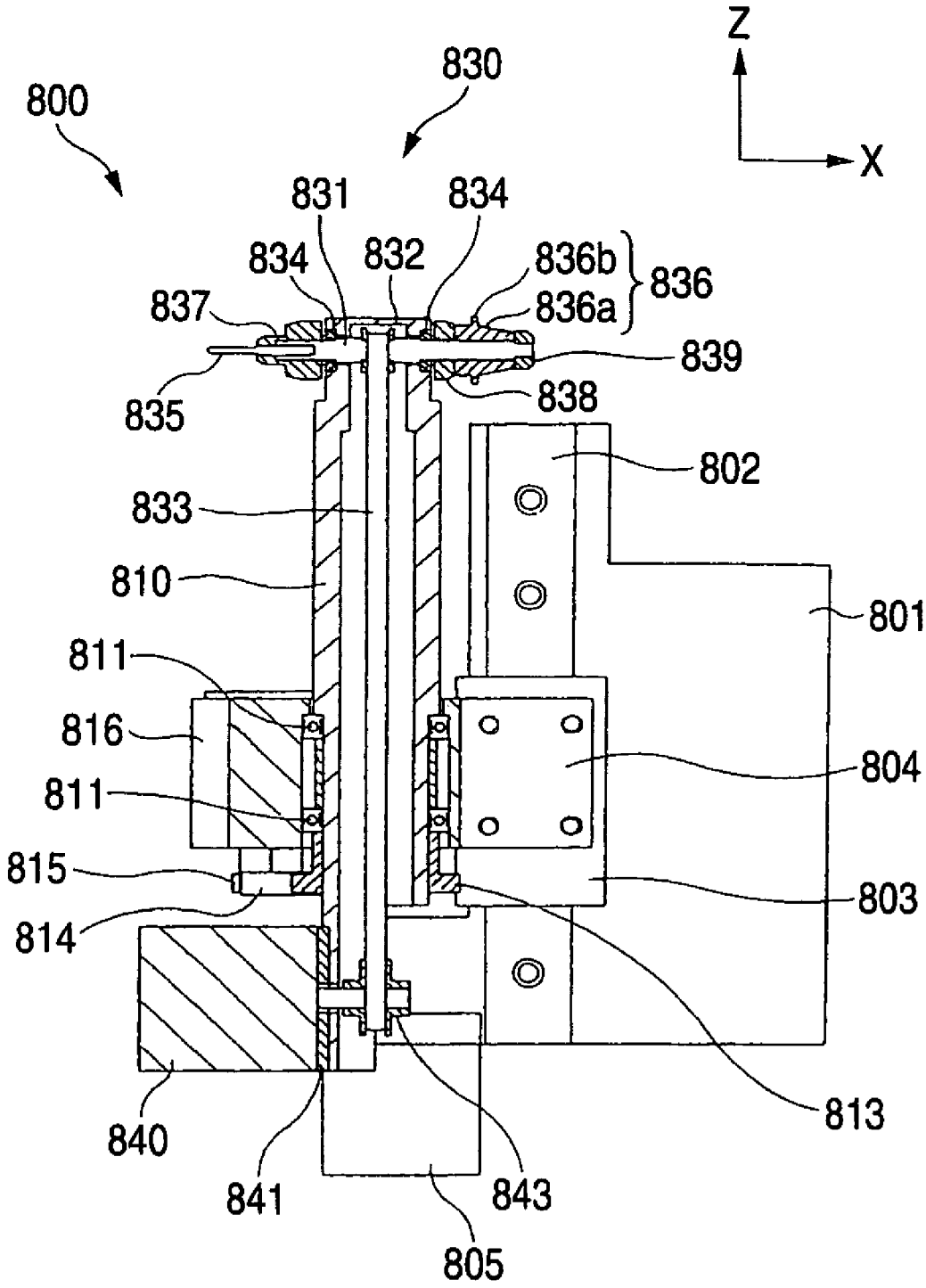
FIG. 5 is a schematic view of the drilling, chamfering and grooving processing part.

FIGS. 4 and 5 shows a schematic configuration of the drilling, chamfering and grooving processing part (unit). A plate 801 to be a base of the processing part 800 is fixed to the sub base 100. A rail 802 extending in a cross direction (direction perpendicular to a X-Y plane: Z-axis direction) fixed to the plate 801, and a slider 803 is slidably supported on the rail 802. A movable support base 804 is fixed to the slider 803, and the movable support base 804 is moved in the cross direction (Z-axis direction) by rotating a ball screw 806 by a motor 805 fixed to the plate 801.

A rotatable support base 810 is pivotally supported by the movable support base 804 through a bearing 811. At one side of the bearing 811, a gear 813 is fixed to the rotatable support base 810. The gear 813 is communicated with a gear 815 attached to a rotating shaft of a motor 816 fixed to the movable support base 804. That is, the rotatable support base 810 is rotated about an axis of the bearing 811 by the rotation of the motor 816.

A rotating portion 830 for holding a processing tool for drilling, chamfering and grooving is provided at a distal end of the rotatable support base 810. A pulley 832 is attached to a center of a rotating shaft 831 of the rotating portion 830, and the rotating shaft 831 is pivotally supported by two bearings 834. An end mill 835 which is a drilling tool is attached to one end of the rotating shaft 831, and a spacer 838 and a grindstone portion 836 are attached to the other end by a nut 839. The grindstone portion 836 includes a grindstone 836*a* for chamfering and a grindstone 836b for grooving.

A motor 840 for rotating the rotating shaft 831 is fixed to a plate 841 attached to the rotatable support base. A pulley 843 is attached to the rotating shaft of the motor 840. A belt 833 is laid between the pulley 832 and the pulley 843 inside the rotatable support base 810, and the rotation of the motor 840 is transmitted to the rotating shaft 831.

Figure 6:
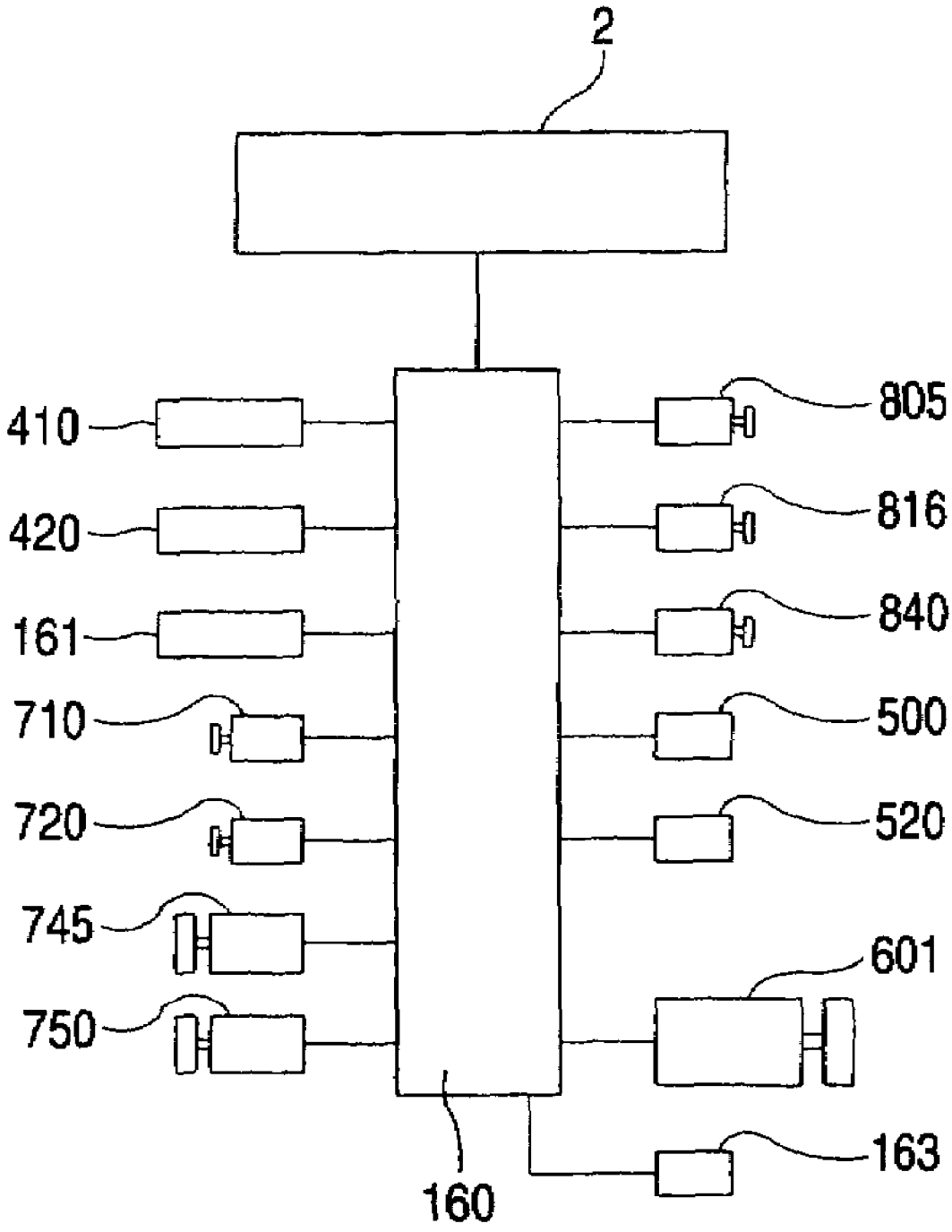
FIG. 6 is a schematic block diagram of a control system of the eyeglass lens processing apparatus.

Using a schematic block diagram of FIG. 6, explanation is made centering on operation of a drilling processing on the apparatus constructed as above.

At first, two-dimensional target lens shape data is input. In the case of a rimless frame, a template or a dummy lens is measured for shape by the measurement device 2, to obtain the target lens shape data. The target lens shape data is input by pressing an external communication key displayed on a touch panel 410 and converted into radius vector data (Rn, θn) (n=1, 2, . . . , N) about a geometric center of the target lens shape as a reference, thus being stored in a data memory 161. The touch panel 410 displays a figure based on the input target lens shape on the screen thereof so that a user (operator) can input processing conditions. By operating the touch keys displayed on the touch panel 410, layout data, e.g. wearer's pupillary distance and optical center height is input. Meanwhile, when a rimless frame is designated as a frame type and hole-position edit is designated, a hole-position edit screen is displayed on the touch panel 410 so that the user can input hole-position data.

Figure 7:
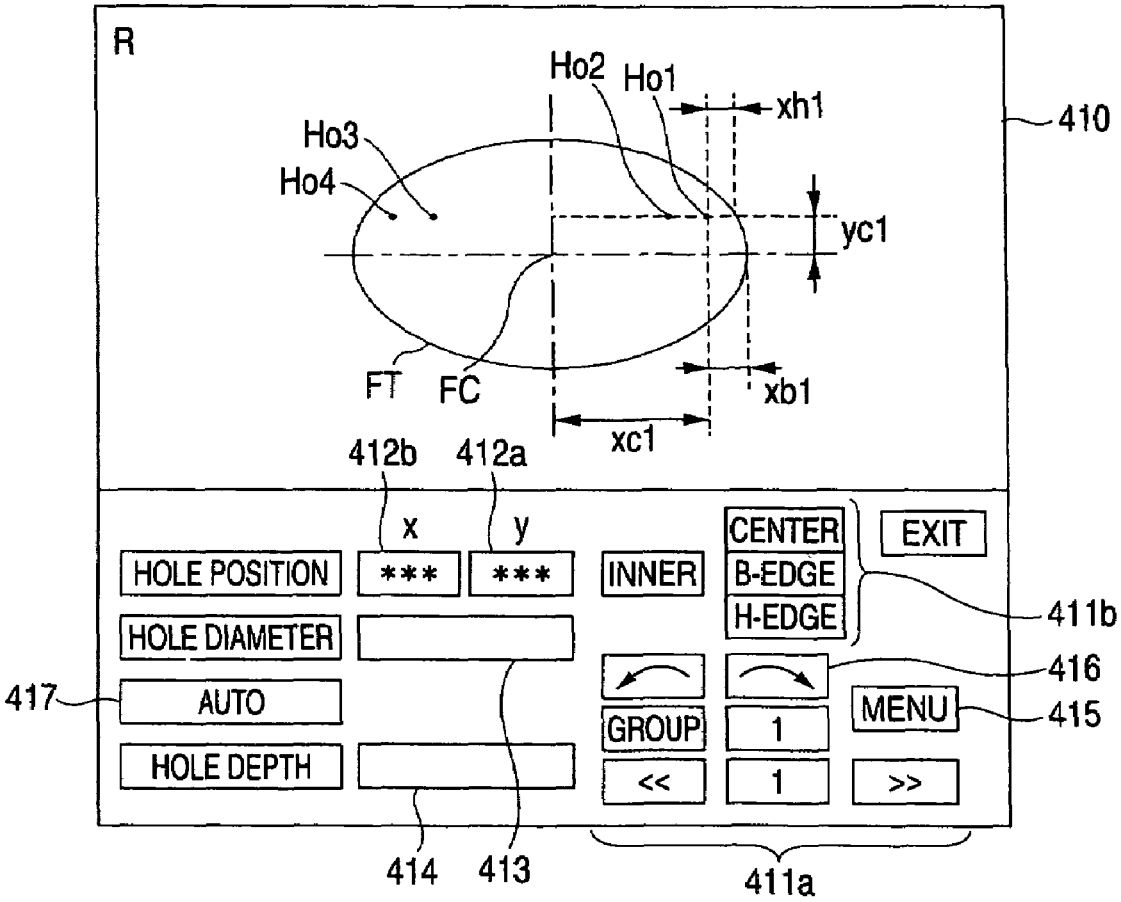
FIG. 7 is an example of a hole-position edit screen displayed on a touch panel.

FIG. 7 is an example of the hole-position edit screen. Here, explanation is made on an example to form two holes at each of the nose and ear sides in a front refractive surface of the lens LE to attach the rimless frame thereon. Here, FC is a geometric center of a target lens shape FT, Ho1 and Ho2 are two holes, at the nose side, for attaching the rimless frame on the (R) lens for a right eye while Ho3 and Ho4 are two holes at the ear side. From now on, explanation is made as to the holes Ho1 and Ho2. The holes Ho1 and Ho2 are assumably formed, side by side, in a direction perpendicular to the front refractive surface (in a direction of a normal line to the front refractive surface) of the lens LE at an intermediate point of the both.

Hole-position data is usually designated with reference to the geometric center FC, on an orthogonal coordinate system having an x-axis direction taken as a horizontal direction and a y-axis direction as a vertical direction of the eyeglasses. For this reason, FIG. 7 uses an input example to the orthogonal coordinate system. Note that this embodiment uses the x-axis and y-axis directions for managing hole-position data distinctly from the X-axis and Y-axis directions used for the processing apparatus main body 1.

When inputting position data for the hole Ho1, hole number is designated with a key 411*a*, y-axis directional position data is designated with a data input box 412*a*, and a dimension yc1 of from the geometric center PC is input. For x-axis directional position data, a data input box 412*b* is designated, and with using a select key 411*b*, one out of thee, i.e. a dimension xc1 of from the geometric center FC (center basis), a dimension xh1 of from a lateral edge of the hole Ho1 (H-edge basis) and a dimension xb1 of from an ear-end edge of the target lens shape (B-edge basis) is selected and the dimension is input. The dimensions are input by use of a ten key displayed upon pressing the data input boxes 412*a*, 412*b*. . The position data for other hole Ho2 can be similarly input by changing the hole number. Incidentally, in the case of two holes, the dimensions may be input with designating a spacing taken with reference to one of the holes Ho1 and Ho2 as a reference. Meanwhile, hole-position data may be input by inputting on a polar coordinate system having the geometric center FC as a reference.

In the case of forming a plurality of holes Ho1 and Ho2 parallel to each other, group number is input by a key 416. When "Auto" is designated by a hole-direction designate key 417, processing can be performed in a direction perpendicular to the front refractive surface at an intermediate point of the holes in the same group. Naturally, it can be at a desired hole-direction.

In FIG. 7, a numeral 413 is a data input box for hole diameter data while a numeral 414 is a data input box for hole depth data for forming a counter-bore (non-through hole). Those dimensions are input by a ten key to be displayed upon pressing the data input boxes. The hole-position data thus input is stored in the memory 161. In the case of processing with communication, the hole-position data and the like from an external apparatus (host computer or the like) is input to a main control section 160 through a communication port 163, and stored in the memory 161.

After completing required input of the hole-position data, etc., the lens LE is held by chuck shafts 702L and 702R. Then, by pressing the processing start switch of the switch portion 420, the apparatus is started up. The main control section 160 controls drive of the lens shape measurement parts 500, 520 depending upon the input target lens shape data, to measure the lens LE for its front and back refractive surface shapes. Namely, the main control section 160 drives the motor 516 to move the arm 504 from a retract position into a measurement position. Thereafter, the motor 750 is driven to move the carriage 701 ib the vertical direction (Y-axis direction) based on the radius vector data (Rn, θn) (n=1, 2, . . . , N) of the target lens shape, while the motor 516 is driven to move the arm 504 in the horizontal direction (X-axis direction) such that the feeler 506 is brought into contact with the front refractive surface of the lens LE. In the state the feeler 506 is in contact with the front refractive surface, the carriage 701 is vertically moved according to the radius vector data of the target lens shape while rotating the lens LE by driving the motor 720. With such rotation and movement of the lens LE, the feeler 506 is moved horizontally along the front refractive surface shape of the lens LE. The travel distance is detected by an encoder 513, and the front refractive surface of the lens LE is measured for shape data (Rn, θn, zn) (n=1, 2, . . . , N). The back refractive surface of the lens LE is also measured for shape data by the lens shape measuring section 520. The measured shape data is stored in the memory 161.

In the case that a rimless-frame processing mode is designated, the main control section.160 further measures the lens LE for its front refractive surface shape by means of a contour (e.g. 1 mm) greater than the radial length Rn by AR in order to determine a curve of the front refractive surface of the lens LE, and stores the shape data (Rn+ΔR, θn, azn) (n=1, 2, . . . , N) in the memory 161. Incidentally, to form a hole in the back refractive surface of the lens LE, the lens LE is measured for its back refractive surface shape by means of a contour greater than the radial length Rn by ΔR in order to determine a curve of back refractive surface of the lens LE.

After measuring the shape of the lens LE, the main control section 160 performs a correcting calculation to manage the target lens shape data and the hole-position data in dimensions along the curve of the front refractive surface of the lens LE. The correcting calculation is explained in the below.

Figure 8:
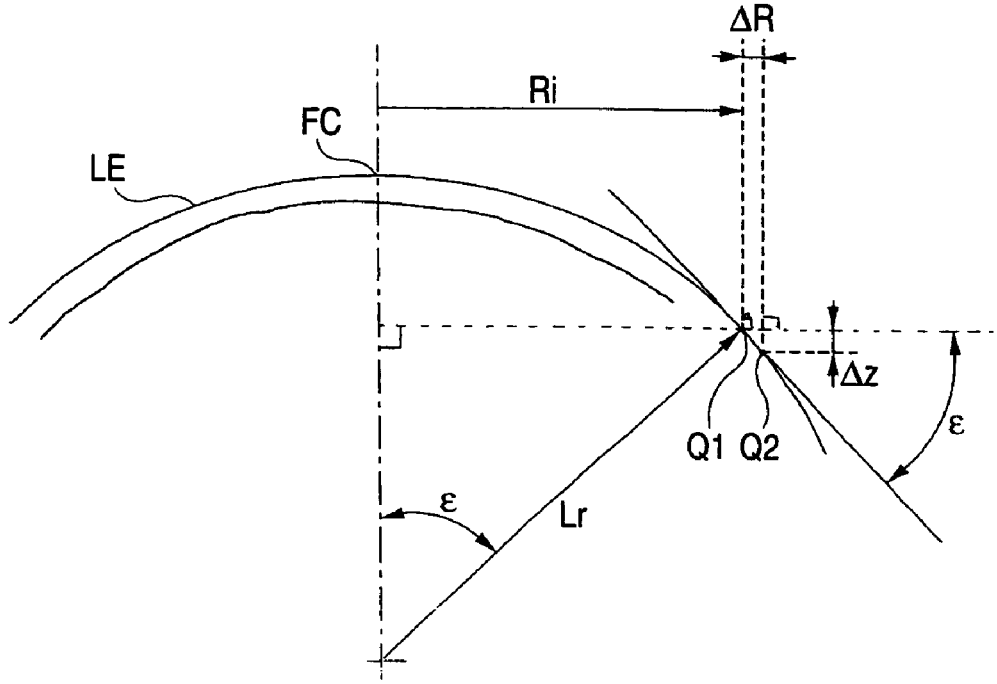
FIG. 8 is a diagram explaining a method to calculate a curve of a front refractive surface of an eyeglass lens.
Figure 9:
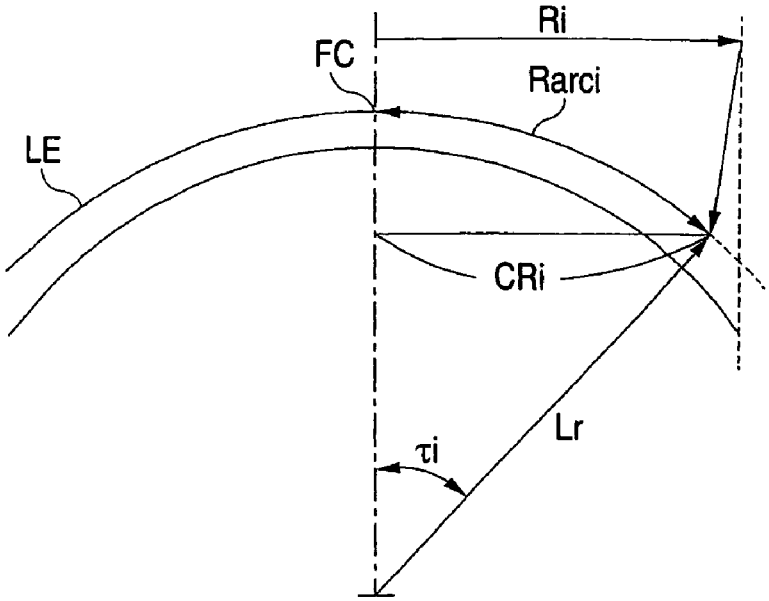
FIG. 9 is a diagram explaining a method of correcting a dimension of a target lens shape into a dimension along the curve of the front refractive surface.

First, a curve (radius) Lr of the front refractive surface of the lens LE is obtained based on the shape data (Rn, θn, zn) (n=1, 2, . . . , N) obtained based on the radius vector data of the target lens shape and the shape data (Rn+ΔR, θn, azn) (n=1, 2, . . . , N) for the contour greater than that by ΔR. As shown in FIG. 8, assumption is made that the measurement point in a radial length Ri at a certain radial angle is Q1 and the measurement point in a radial length ΔR greater than Ri at the same radial angle is Q2. Based on the difference Δz in the horizontal direction (X-axis direction) between the two points and the radius length difference ΔR between those, an inclination angle ϵ of a tangent line at the measurement point Q1 is approximately determined from the following equation.

$$\Delta z/\Delta R=\tan \epsilon \quad \text{(Equation 1)}$$

By obtaining the inclination angle ϵ, the curve Lr is determined from the following equation.

$$Lr=Ri/\sin \epsilon \quad \text{(Equation 2)}$$

Although the curve Lr of the front refractive surface of the lens LE may be determined from the partially refractive surface shape at around the hole, the curve Lr is preferably determined as an average value of the whole refractive surface shape. Where the curve Lr of the front refractive surface of the lens LE is previously known, the curve Lr is input to the main control section 160 from the external apparatus (host computer or the like).

Then, using the curve Lr, the target lens shape dimensions are corrected into dimensions along the curve Lr. The correction is regardless of the coordinate system at the time of input of the hole-position data, and there are a calculation method based on the polar coordinate system and a calculation method based on the orthogonal coordinate system.

The case of a calculation on the polar coordinate system will be described. In order to correct the target lens shape dimensions to dimensions along the front refractive surface curve, a radial length Ri and an arc length Rarci are set to be equal to each other. In this case, the angle τi for the length Rarci is determined from the following equation.

$$\tau i=360°\times Ri/(2\times\pi\times Lr) \quad \text{(Equation 3)}$$

In this case, a corrected radial length CRi is determined from the following equation.

$$CRi=Lr\times\sin \tau i \quad \text{(Equation 4)}$$

This calculation is applied to every point on the entire circumference of the target lens shape. Namely, the corrected radial length (radius) CRn (n=1, 2, . . . , N) over the entire circumference of the target lens shape is determined from the following equation.

$$CRn=Lr\times\sin\{360°\times Rn/(2\times\pi\times Lr)\}(n=1, 2, \ldots, N) \quad \text{(Equation 5)}$$

The designated hole positions are also corrected by using Equation 5. Where the hole-position data is designated on the orthogonal coordinate system, the hole position data are once converted into those on the polar coordinate system.

Figure 10A:
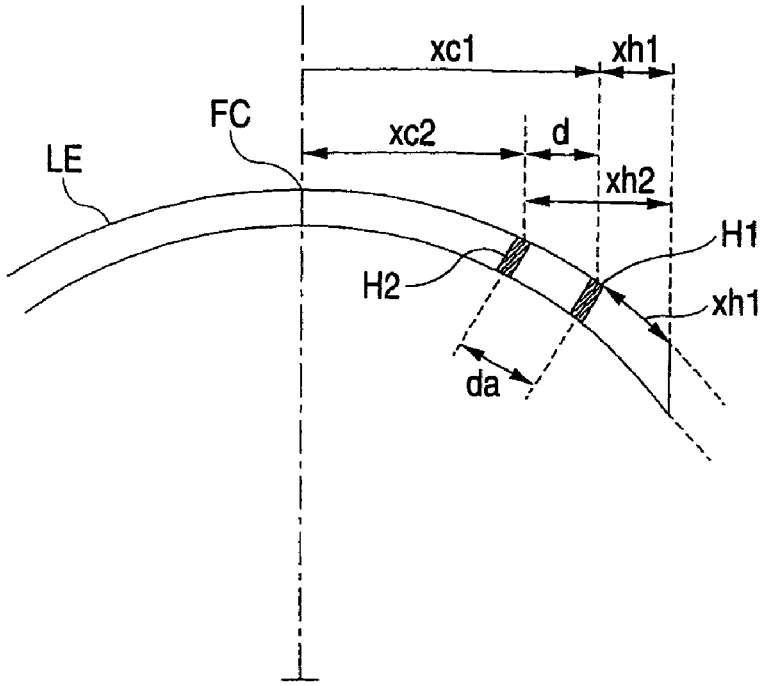
FIGS. 10A and 10B are diagrams explaining the case of processing in hole positions designated on a two-dimensional coordinate system and the case of processing in hole positions corrected to the dimension along the curve of the front refractive surface according to the invention, in processing two holes.
Figure 10B:
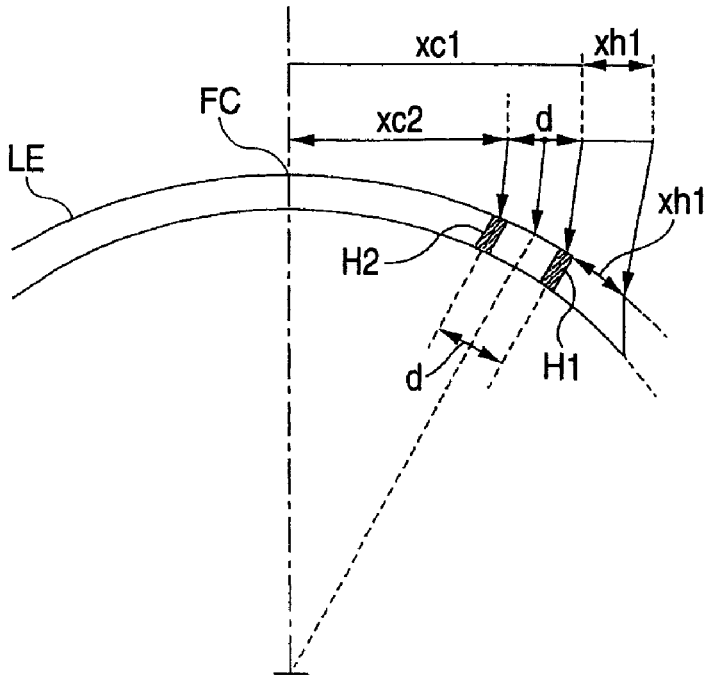

The main control section 160 manages the input target lens shape dimensions and the input hole-position dimensions in terms of the dimensions along the curve of front refractive surface of the lens LE obtained by the correcting calculation, and determines drilling processing data. The drilling processing data can be determined by converting the hole-position data and the hole-direction data into horizontal-directional (X-axis directional) movement data of the carriage 701, vertical-directional (Y-axis directional) movement data thereof, rotation angle data of the lens LE, cross-directional (Z-axis directional) movement data of the processing part 800, rotation angle data of the rotating portion 830 and so on. Meanwhile, the main control section 160 obtains peripheral edge-processing data by determining lens-rotation-based processing points depending upon the corrected target lens shape data. Where there is designated a method to form plural side-by-side holes which are to be arranged parallel to each other, a hole direction is determined to be perpendicular to the front refractive surface at an intermediate point of the holes. Meanwhile, hole positions are determined such that the hole spacing at an inclination angle of the front refractive surface at the hole intermediate position is equal to a input hole spacing d. This makes it possible to arrange the hole positions designated on the two-dimensional system onto a three-dimensional lens refractive surface without any contraction. Namely, the two-hole spacing as viewed in a direction along the curve of the front refractive surface is provided equal to the spacing d designated as shown in FIG. 10B, in contrast to the case of the two-hole spacing as shown in FIG. 10A. Meanwhile, where the hole H1 is designated with a dimension xh1 from the lateral edge of the hole H1, arrangement is possible, without any contradiction, at a position in the dimension xh1 as viewed in the direction along the curve of the front refractive surface similarly to the method to designate a hole-position dimension from the geometric center FC. Where position data of the holes Ho1 and Ho2 is input at different radial angles as in FIG. 7, by determining hole-position data in the dimensions along the curve of the refractive surface by a similar correcting calculation, the hole positions can be arranged on a three-dimensional lens refractive surface without any contradiction.

When the correcting calculation is made on the orthogonal coordinate system instead of the above correcting calculation on the polar coordinate system, the term Rn in equation 5 is replaced with xn and yn in terms of every point throughout the entire circumference of the target lens shape, to calculate corrected coordinates Cxn, Cyn (n=1, 2, . . . , N). On this occasion, the curve Lr is calculated without positional change. For the designated hole positions, the term Rn in equation 5 is replaced into the orthogonal coordinate system value, to calculate x and y corrected coordinates thereof.

Figure 11A:
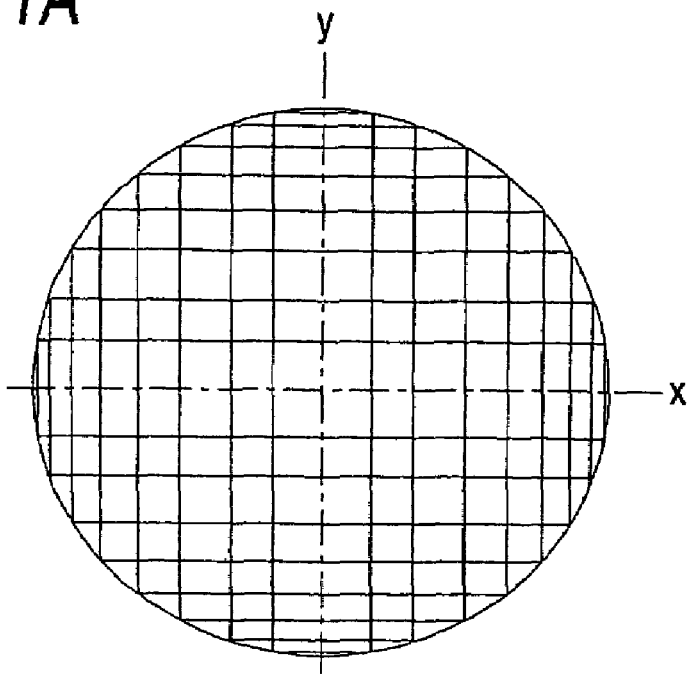
FIGS. 11A and 11B are diagrams explaining a correction with an orthogonal coordinate system and a correction with a polar coordinate system, on a three-dimensional spherical surface.

The correction on the orthogonal coordinate system is quite similar to the case of considering a parallel of latitude, representing a position on the earth surface, as an orthographic projection figure (see FIG. 11A). Meanwhile, the correction on the polar coordinate system explained before is quite similar to the case of considering a line of longitude, representing a position on the earth surface, as an orthographic projection figure (see FIG. 11B).

Figure 11B:
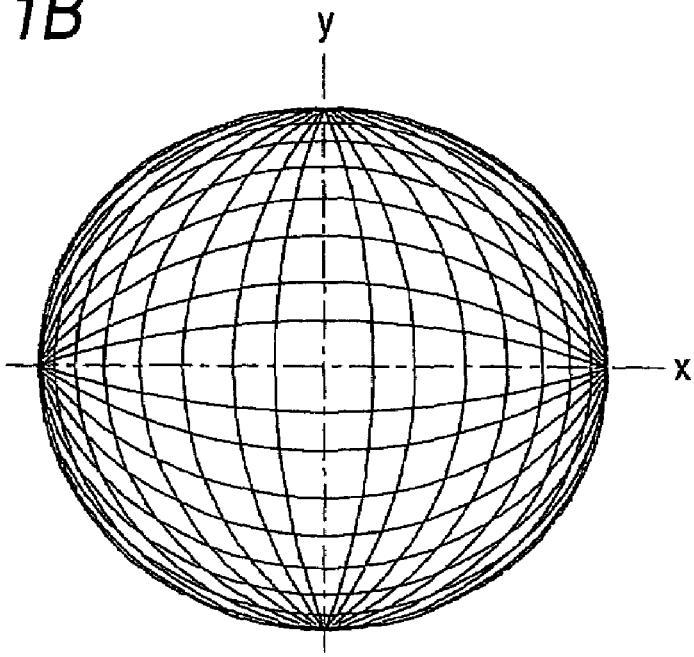
Figure 12:
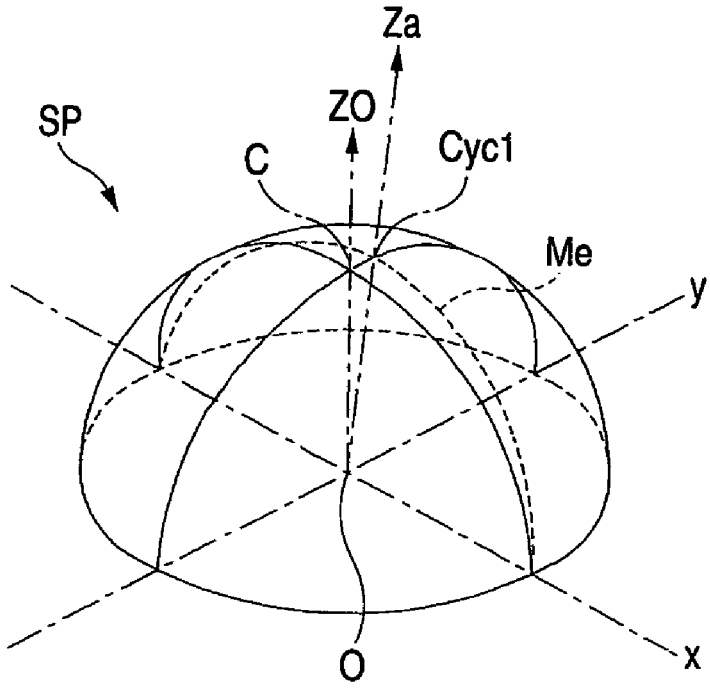
FIG. 12 is a diagram explaining a correction on a polar coordinate system.

In the meanwhile, in the correction on the polar coordinate system, the correction amount on y-axis coordinate increases as the dimension on x-axis coordinate of from the geometric center FC increases, as shown in FIG. 11B. In the case of forming two holes Ho1 and Ho2 equal in y-coordinate yc1, the two holes in the first glance are seen not arranged side by side immediately laterally. However, this is a proper arrangement when viewed in a vertical direction (normal direction) of the lens refractive surface. Namely, when considering a sphere SP in a three-dimensional shape as shown in FIG. 12, correcting a y-axis coordinate in the polar coordinate system is done on a latitude line Me passing a position Cyc1 on y-axis of the sphere SP. The line-of-longitude Me is a curved line if viewed in a zo-axis direction perpendicular to an xy-plane, but it is a straight line when viewed in a za-axis direction passing a position Crys1 on y-axis and a spherical center O of the sphere.

Figure 13A:
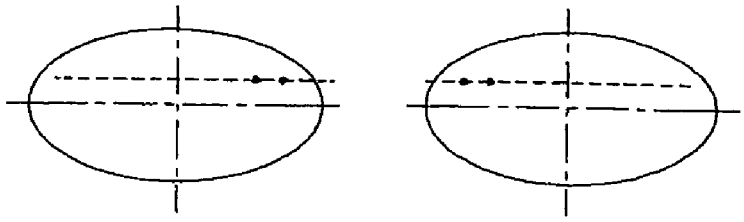
FIG. 13A and 13B are diagrams showing a look, as viewed with reference to a hole position, of a the eyeglass lens processed according to a correction on the orthogonal coordinate system.
Figure 13B:
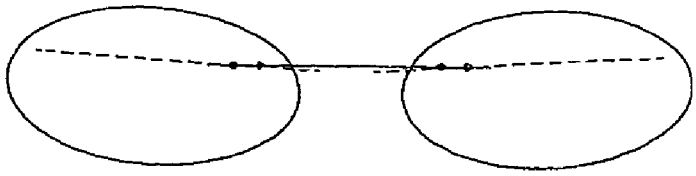

Here, consider the case that two holes (holes closer to the nose), y coordinates of which designated on the two-dimensional coordinate system are equal to each other, are formed perpendicular to the front refractive surface in a designated position same as the conventional or in a corrected position on the orthogonal coordinate system, as shown in FIG. 13A. In case of viewing the eyeglasses actually fit the rimless frame on the lens with reference to a hole position, then the left and right target lens shapes are in a shape somewhat raised at ear-side relative to the nose side, as shown in FIG. 13B. This disadvantage is to be eliminated by using the polar-coordinate-system correction method. Meanwhile, where the eyeglasses fit with the rimless frame is viewed with reference to the geometric center of the target lens shape, it is satisfactory to use the orthogonal-coordinate-system correction system.

In this manner, there are a somewhat difference in correction result between orthogonal-coordinate-based and polar-coordinate-based corrections. This is due to a difference in the coordinate system under management (difference of viewpoint). The both are possible without any contradiction in respect of the arrangement of a hole position designated on the two-dimensional coordinate system onto the three-dimensional spherical surface. However, because correction results are different between the both, selection is preferably allowed in accordance with user's needs. By pressing a menu key 415 on the touch panel 410 and opening a menu screen, a screen is displayed for a selection as to whether to apply any of polar-coordinate-based and orthogonal-coordinate-based corrections. The control section 160 changes the correcting calculation to be applied depending upon an input of a selection signal.

Meanwhile, in the case of correction on the orthogonal coordinate system, it may be only on one of the x-axis and y-axis direction. There is less practical problem in making a correction only on the x-axis direction because the hole position on the y-axis direction is usually small in value relative to the geometric center FC.

The main control section 160, after completing the correcting calculation, performs peripheral edge processing on the lens LE. The main control section 160 moves the carriage 701 by the motor 720 such that the lens LE comes to the above of the roughing grindstone 602*b*, and then vertically moves the carriage 701 by the motor 750 thereby performing roughing processing. Then, the lens LE is moved to a flat portion of the finishing grindstone 602*c*, to make finishing processing by vertically moving the carriage 701 similarly. In the peripheral edge processing of the lens LE, operation is preferably based on the radius vector data (CRn, θn) (n=1, 2, . . . , N) of the target lens shape corrected along the curve of the lens refractive surface. Incidentally, although the corrected radius vector data (CRn, θn) is smaller than the input radius vector data (Rn, θn), the difference thereof is in a degree practically not problematic for the case with the rimless frame. For example, where to process the lens LE based n the target lens shape having the curve value of 5 and the radius of 30 mm, the difference is 0.1 mm or smaller.

Figure 14:
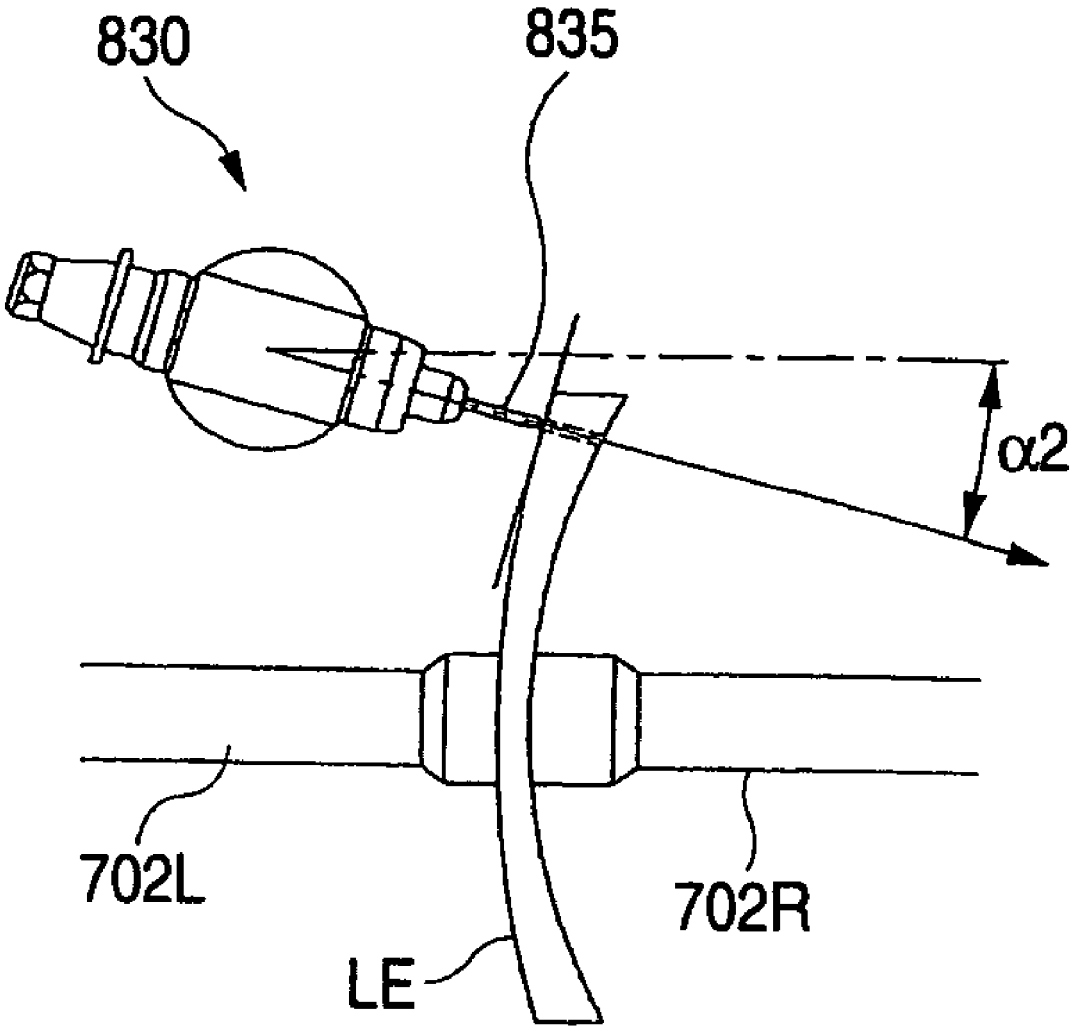
FIG. 14 is a view explaining drilling processing with an end mill.

After completing the finishing processing, the drilling processing is followed subsequently. The main control section 160 takes control of movement of the carriage 701 and processing part 800 according to the correction data to the holes Ho1 and Ho2. When forming two side-by-side holes perpendicular to the lens refractive surface, a hole angle α2 is previously determined such that the intermediate point of the two holes is perpendicular to the lens refractive surface (see FIG. 14). The main control section 160 inclines the rotation axis of the end mill 835 by the angle α2 relative to the horizontal direction (X-axis direction), and controls the rotation of the lens LE and the movement in the horizontal direction (X-axis direction) and the vertical direction (Y-axis direction) of the carriage 701, thereby placing the distal end of the end mill 835 in the corrected hole position. Thereafter, the end mill 835 is rotated by the motor 840, to move the carriage 701 axially (in a direction of the angle α2) of the rotation axis of the end mill 835, thereby forming a hole. Another hole is made similarly by placing the distal end of the end mill 835 in the corrected hole position while maintaining the angle $\alpha 2$. This makes it possible to form holes on the three-dimensional refractive surface according to the positions designated on the two-dimensional coordinate system without any contradiction.

Drilling processing is available in a desired direction relative to the lens refractive surface. In this case, a menu screen is displayed by a angle designate key 417 of FIG. 7, to designate a desired angle on the screen displayed. When a predetermined angle is designated, the main control section 160 determines the axial direction of the end mill 835, the rotation angle of the lens LE and the cross-directional (Z-axis direction) position of the rotating portion 830 based on the designated angle. Then, the drilling processing is performed by moving the carriage 701 in the XY directions. The drilling processing control is basically identical to that of U.S. Pat. No. 6,790,124 (JP-A-2003-145328), and omitted to explain in detail.

The explanation made so far is in forming a through hole. However, when forming a counter-bore (non-through hole), hole-position data is to be used with similar 28 corrections. In this case, input are hole-diameter data, hole-depth data and so on.

Meanwhile, the lens LE may be a monofocal lens or a progressive power lens. In the case of the progressive power lens, the front refractive surface differs in curve from point to point. However, there is less practical error if determining an average value over refractive surface process measured the lens shape throughout the entire circumference.

In the above-described embodiment, the apparatus of the type that the carriage 701, having the chuck shaft that clamps and rotates the lens LE, is moved in the horizontal direction (X-axis direction) and in the vertical direction (Y-axis direction) is employed. However, it may be in a structure to move the rotating portion 830 (end mill 835) in three-dimensional directions.

What is claimed is:

1. An eyeglass lens processing apparatus comprising:

a drilling tool for forming holes in a refractive surface of an eyeglass lens to attach a rimless frame to the lens;

a lens chuck shaft that holds and rotates the lens;

an inclining device that relatively inclines the drilling tool relative to the lens;

a movement mechanism part that relatively moves the drilling tool in a rotating axis direction thereof relative to the lens;

a target lens shape and layout input section that inputs data of a target lens shape of the frame and data of a layout of the lens with respect to the frame by a communication or an input key;

a hole-position input section that inputs data of hole positions which are designated in a two-dimensional coordinate system on the target lens shape by a communication or an input key;

a section that measures or inputs a curved shape of the refractive surface of the lens;

a calculation section that calculates each modified two-dimensional hole position so that a two-dimensional spacing between the holes coincide with a three-dimensional spacing between the holes along the refractive surface of the lens based on the each input two-dimensional hole position and the curved shape, and determines hole processing data based on the each modified two-dimensional hole position; and a control section that controls the movement mechanism part based on the determined hole processing data.

2. The eyeglass lens processing apparatus according to claim 1, wherein the calculation section determines the each modified two-dimensional hole position by associating a length of the each input two-dimensional hole position from a processing center with an arc length along the refractive surface of the lens.

3. The eyeglass lens processing apparatus according to claim 1, wherein, when the each input two-dimensional hole position is represented by (x, y) on an orthogonal coordinate system, the calculation section determines the each modified two-dimensional hole position by associating at least one of x and y with an arc length along the refractive surface of the lens.

4. The eyeglass lens processing apparatus according to claim 1, wherein the calculation section obtains a corrected target lens shape by associating a radial length of the input target lens shape with an arc length along the refractive surface of the lens, and obtains the each modified two-dimensional hole position by associating a length of the each input two-dimensional hole position from a processing center with an arc length along the refractive surface of the lens.

5. The eyeglass lens processing apparatus according to claim 1, wherein, when the input target lens shape is represented by (xl, y1) on an orthogonal coordinate system, the calculation section obtains a corrected target lens shape by associating xl and y1 with an arc length along the refractive surface of the lens, and when the each input two-dimensional hole position is represented by (x2, y2) on the orthogonal coordinate system, the calculation section obtains the each modified two-dimensional position by associating at least one of x2 and y2 with an arc length along the refractive surface of the lens.

* * * * *